US005540276A

United States Patent [19]

Adams et al.

[11] Patent Number: 5,540,276

[45] Date of Patent: Jul. 30, 1996

[54] FINNED TUBE HEAT EXCHANGER AND METHOD OF MANUFACTURE

[75] Inventors: Michael B. Adams, Sylvania, Ohio; Milan Virsik, Adrian, Mich.

[73] Assignee: Brazeway, Inc., Adrian, Mich.

[21] Appl. No.: 371,816

[22] Filed: Jan. 12, 1995

[51] Int. Cl.[6] ..... F28D 1/04

[52] U.S. Cl. ..... 165/151; 165/150

[58] Field of Search ..... 165/151, 150, 165/162

[56] References Cited

U.S. PATENT DOCUMENTS

| | | | |
|---|---|---|---|
| 1,775,041 | 9/1930 | Karmazin | 165/151 |
| 2,437,452 | 3/1948 | Baird | 165/150 |
| 3,286,328 | 11/1966 | Anderson | 165/151 |
| 3,345,726 | 10/1967 | Huckman et al. | 29/890.07 |
| 3,780,799 | 12/1973 | Pasternak | 165/150 |
| 3,982,311 | 9/1976 | Rasmussen | 29/33 G |
| 4,325,171 | 4/1982 | Nobles | 29/157.3 C |
| 4,357,990 | 11/1982 | Melnyk | 165/76 |
| 4,365,667 | 12/1982 | Hatada et al. | 165/152 |
| 4,446,915 | 5/1984 | Welch et al. | 165/150 X |
| 4,492,851 | 1/1985 | Carr | 219/201 |
| 4,625,378 | 12/1986 | Tanno et al. | 29/157.3 A |
| 5,036,909 | 8/1991 | Whitehead et al. | 165/133 |
| 5,219,023 | 6/1993 | Kadle | 165/110 |

FOREIGN PATENT DOCUMENTS

| | | | |
|---|---|---|---|
| 0182090 | 10/1983 | Japan | 165/150 |
| 0243295 | 10/1986 | Japan | 165/151 |
| 0052398 | 3/1987 | Japan | 165/151 |
| 0180091 | 7/1988 | Japan | 165/162 |
| 0223792 | 9/1990 | Japan | 165/150 |

*Primary Examiner*—John Rivell
*Assistant Examiner*—Christopher Atkinson
*Attorney, Agent, or Firm*—Young & Basile

[57] ABSTRACT

A heat exchanger of the finned tube type in which the tubing is formed in a single, continuous length which is bent into a zigzagged or serpentine shape and then inserted through elongated slots formed in a series of fin plates. The invention provides for the production of heat exchangers in which the spacing between tube passes through the heat exchanger, and so the flow pattern of the refrigerant, may be varied to meet the design considerations of the particular heat exchanger application.

9 Claims, 3 Drawing Sheets

FINNED TUBE HEAT EXCHANGER AND METHOD OF MANUFACTURE

FIELD OF THE INVENTION

This invention relates to heat exchangers of the finned tube type, and more particularly to a manufacturing method which permits the tubing to be formed as a single, continuous serpentine before being joined with the fin bank.

BACKGROUND OF THE INVENTION

Finned tube heat exchangers are commonly used in refrigeration and air-conditioning systems. A typical heat exchanger, for purposes of discussion, comprises a bank of spaced, parallel thin metal plates having holes formed in them to accept parallel runs of hollow metal tubes, typically aluminum or copper. When joined with the tubes, the plates become fins which greatly increase the surface area available for thermal transfer between the fluid in the tube and the air contacting the fins. The tubes are joined with one another to provide a continuous fluid passage for a fluid or refrigerant between an inlet and an outlet. The heat exchanger may be an evaporator or a condenser.

One method of constructing such a heat exchanger involves passing elongated U-shaped sections of tubing, known as hairpins, through the holes formed in the fins. The hairpins are then interconnected at their open ends with short U-shaped tubes called return bends, so as to form a zigzag flow path through the tubing. The return bends are usually connected to the hairpins by brazing, an operation that must be closely controlled to assure a high quality product.

Another method of constructing such a heat exchanger involves bending a single, continuous length of tube into a zigzag pattern, or serpentine, with parallel tube runs connected to one another by constant radius 180 degree bends at either end. The fin plates are formed with a regular pattern of elongated slots and arranged in a fin bank with the slots in alignment. The serpentine is then inserted, or "telescoped," into the fin pack, with the bends at one end of the serpentine passing completely through the slots of the fin pack, leaving the straight runs of tubing disposed in the ends of the slots. This method has the advantage of requiring fewer brazed joints and is compatible with automated production equipment. The method and the resulting product are described in U.S. Pat. No. 3,345,726 to Charles Hickman.

Another method of constructing a finned tube heat exchanger with a continuous serpentine is shown in U.S. Pat. No. 4,625,378 to Tanno et al. In this construction, small fin plates having only two through-punched holes are arranged in a fin bank, and the straight portions of a single long hairpin are passed through the aligned holes. The resulting structure is then bent into a zigzag configuration to give the desired number of tube passes. A heat exchanger made by this method is limited to having only two rows of tube passes.

Both the Hickman and Tanno methods are limited in that, at least as applied in an automated high volume production process, they produce a heat exchanger having a uniform, evenly spaced pattern of tube runs. This is a consequence of the fact that the machinery which bends the tubing into a serpentine can only easily produce bends of a single, predetermined radius. Thus, each run of tubing is separated from its neighbors by a distance equal to twice the bend radius.

In many heat exchanger applications it is desirable to have a fluid flow path other than the regular pattern described above. By varying the distance between the tube passes it is possible to generate different temperature and pressure gradients within the fin bank, alter the air flow, and change the air pressure drop, frost load, and heat absorption. All of these factors relate directly to the performance and efficiency of a refrigeration system. In the past, the only way to construct a heat exchanger with such a customized, non-regular layout has been with the brazed hairpin construction described above.

SUMMARY OF THE INVENTION

The present invention makes the construction of heat exchangers having customized, non-uniform flow patterns compatible with the manufacturing process in which a single length of tubing is bent into a serpentine and then inserted through slots in the fin pack. This is achieved by forming the serpentine so that certain of the bends, rather than being constant radius 180 degree bends, consist of a compound bend in which two 90 degree bends are connected by a straight run. Where one of these compound bends connects two adjacent lengths of tubing, there exists a "gap" in the tube pass pattern of the final heat exchanger. This gap takes the form of either a skipped pair of tube runs within a row, or, in a multiple row heat exchanger, a row that is skipped completely.

In constructing the tubing serpentine used in the heat exchanger of the present invention, all of the bends formed, whether 90 degrees or 180 degrees, have the same radius of curvature. This greatly simplifies the fabrication of the tubing serpentine, and allows the use of existing tube bending machinery with only minor changes in the program controlling this machinery.

In an alternative embodiment of the present invention a multiple row heat exchanger is provided in which the alternating rows are offset from one another along the direction of air flow through the heat exchanger. This offset layout may be necessary to increase the distance between tube runs in adjacent rows without increasing the overall dimensions of the heat exchanger. By properly applying the principles of the present invention it is possible to construct a heat exchanger with such an offset layout and also having gaps in the tube pass pattern as may be required in custom applications.

The present invention allows the production of heat exchangers having a wide variety of tube layouts, all of which use fins having a standard slot pattern. Heat exchangers having non-regular tubing layouts may thus be constructed for custom applications without the need to resort to the labor-intensive brazed hairpin construction technique. The customized heat exchangers may be produced using the same production equipment currently in use, with no need for additional capital expenditures.

DETAILED DESCRIPTION OF THE PREFERRED EMBODIMENT

Prior Art

Figure 1:
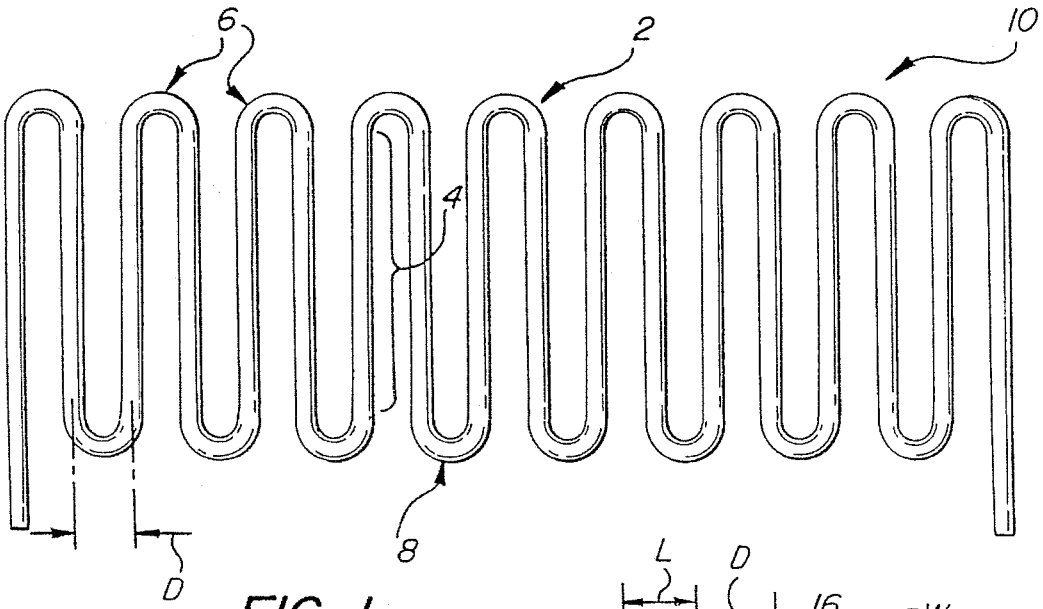
FIG-1 (PRIOR ART)
FIG. 1 is a plan view of a prior art tubing serpentine for a three row heat exchanger, before it has been bent out of plane.
Figure 2:
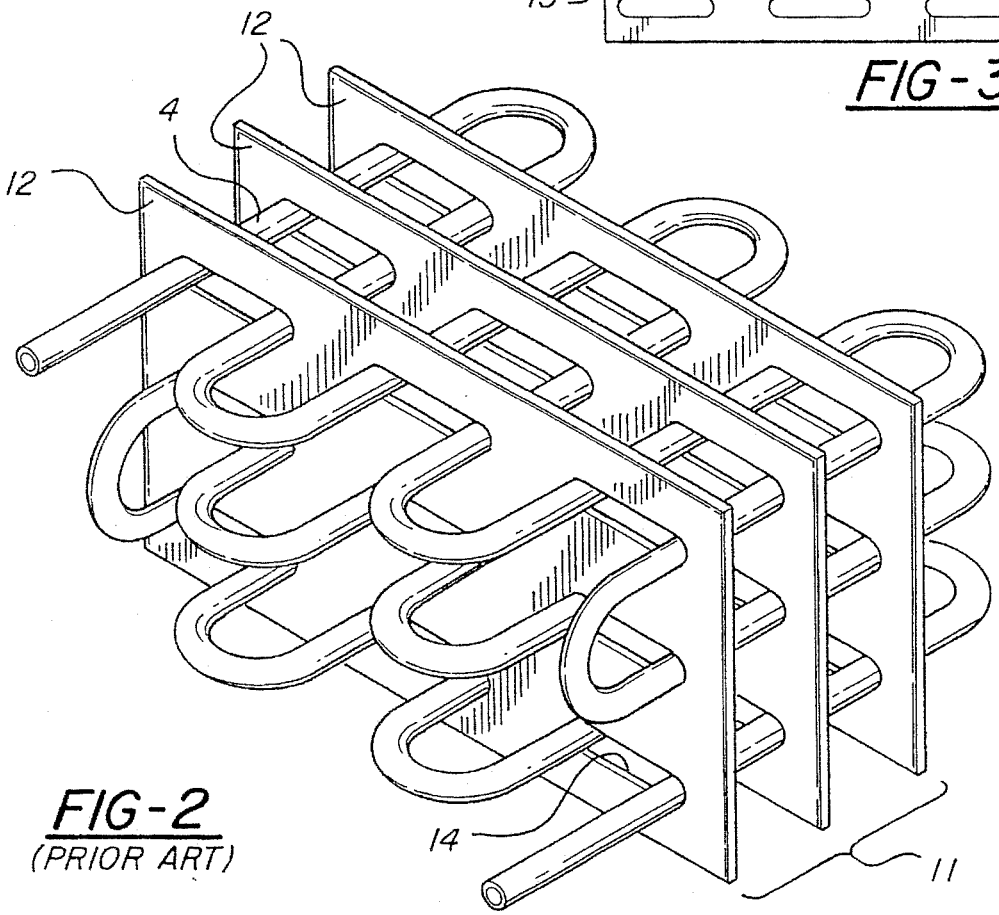
FIG-2 (PRIOR ART)
FIG. 2 is a perspective view of the prior art serpentine of FIG. 1.

FIG. 1 illustrates an example of a tubing serpentine formed by the prior art method as disclosed in U.S. Pat. No. 3,345,726 to Hickman et al., and incorporated herein by reference. This example is for use in an 18-pass, 3-row heat exchanger as shown in FIG. 2. Although serpentine 2 is formed by bending a continuous, seamless length of tubing, it is, for descriptive purposes, subdivided into several discrete portions. The serpentine is made up of a plurality of straight, evenly spaced tube runs 4, which are connected in adjacent pairs by return bends 6 located at what is referred to as the leading end of the serpentine. The thus formed tube run pairs 10 are integrally connected along the trailing end of the serpentine by constant radius bends 8 to establish a continuous, zigzag flow path. In this prior art serpentine, all of the return bends 6 and connecting bends 8 are 180 degree bends of equal radius.

To form the heat exchanger shown in FIG. 2, serpentine 2 is then bent out of plane to form three parallel rows, each having three tube run pairs 10, and inserted, or "telescoped," into a fin bank 11, with the leading end passing through slots 14 formed in the fins 12. Each slot is wide enough to accommodate two tube runs.

Present Invention

Figure 3:
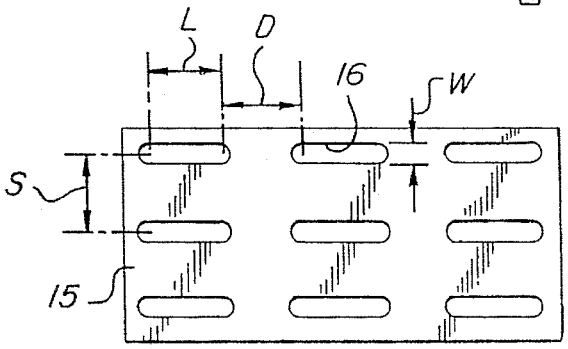
FIG. 3 is a plan view of a fin plate used in a heat exchanger embodying the present invention.

FIG. 3 is a plan view of a fin 15 suitable for use with a tube serpentine formed in accordance with the present invention. In the preferred embodiment, fin 15 is made from aluminum sheet on the order of 0.007 inches thick, and slots 16 are formed by a stamping or punching process. Slots 16 are essentially rectangular but with semicircular ends. The width W of each slot 16 is approximately equal to the diameter of the semicircular end portion and the distance between the centers of curvature of the end portions is L. The distance D between centers of adjacent slot ends in a horizontal row is equal to the spacing S between the centers of adjacent slots in a vertical column. The width W is equal to the tube diameter to be used. In the preferred embodiment, L=D=S; i.e, the slot pattern is equilateral.

Figure 4:
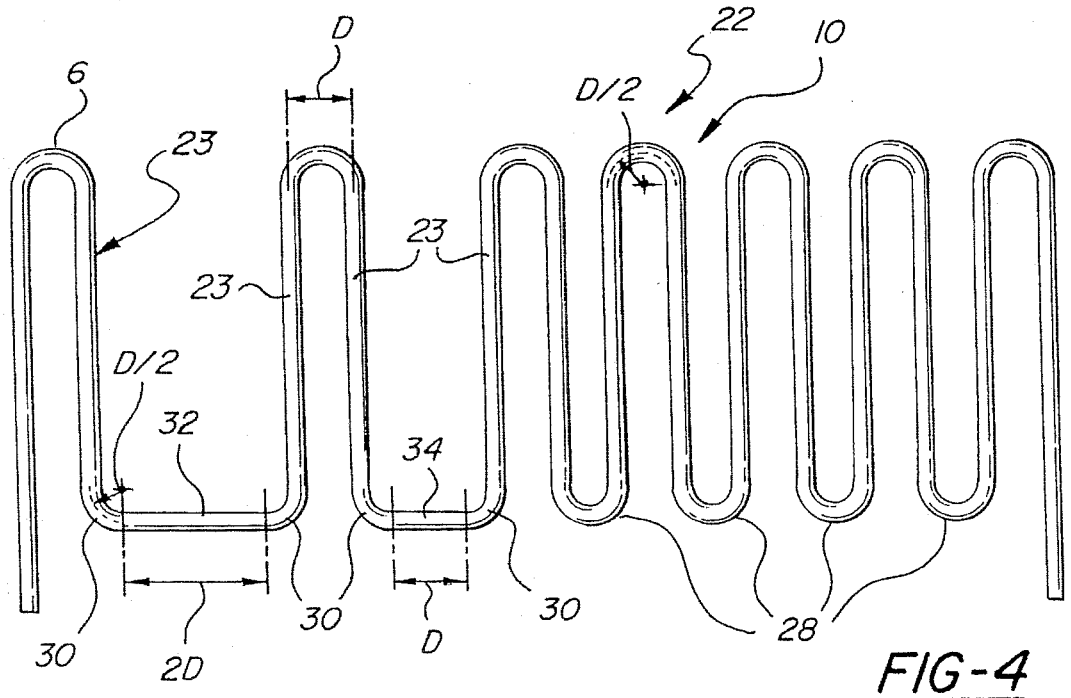
FIG. 4 is a plan view of a tubing serpentine embodying the present invention, as used in a three row heat exchanger, prior to being bent out of plane.

Referring now to FIG. 4, there is shown a serpentine 22 of extruded metal tubing having an external diameter equal to W. The serpentine 22 is formed by suitable means to exhibit an even number of parallel runs 23 joined by return bends 6 between a fluid inlet 24 and an outlet 26. Some adjacent runs are integrally joined by constant radius 180 degree connecting bends 28 having a radius equal to D/2 while others are joined by elongated connecting bends composed to two 90 degree bends 30 (also of radius equal to D/2) and intermediate straight sections 32 and 34. The length of the straight section can vary, depending on the desired geometry of heat exchanger to be produced, but is always an integer multiple of the distance D; in the illustrated embodiment, the length of straight section 32 is equal to 2D, and the length of the section 34 is equal to D.

The next step in the forming process is to bend serpentine 22 out of plane, thereby arranging parallel runs 23 into three rows. This is accomplished by making out of plane bends at the locations indicated at B1 through B4 in FIG. 4. All four of these bends are made in a clockwise direction when the serpentine is viewed from its trailing end, i.e. the end at which inlet 24 and outlet 26 lie.

Figure 5:
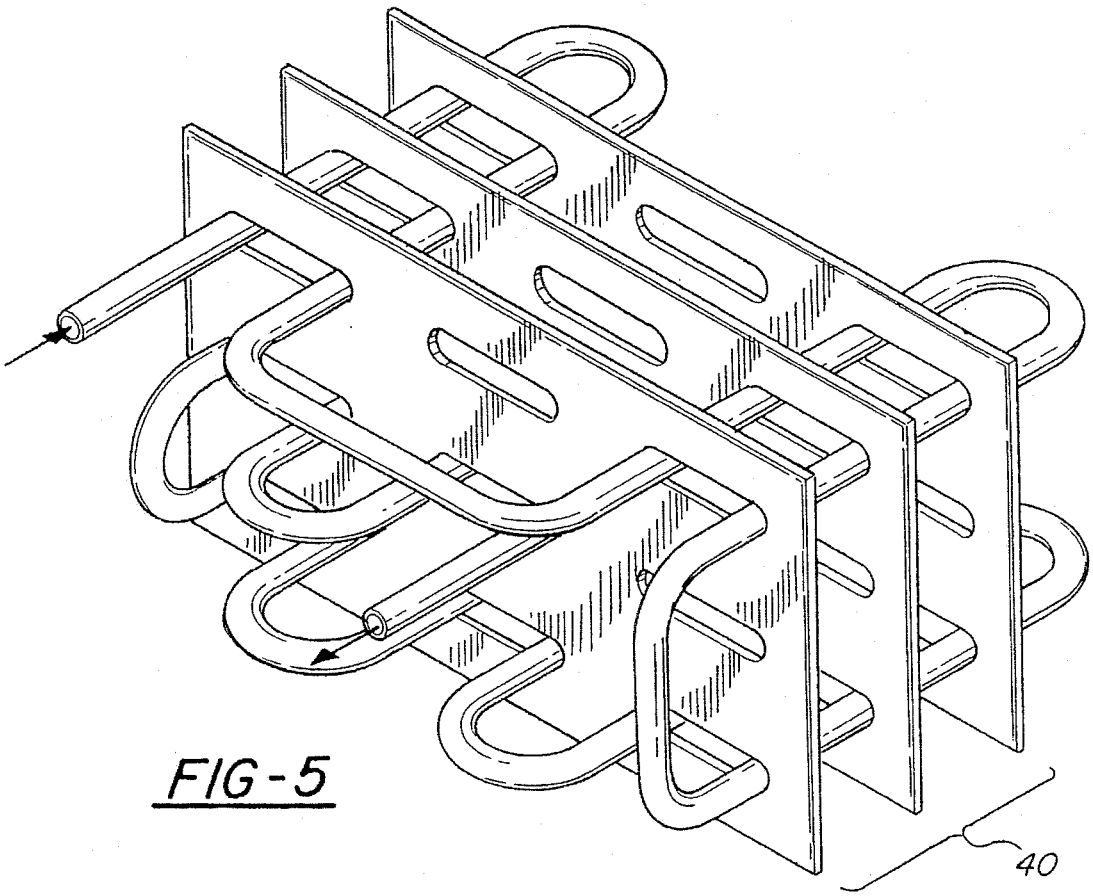
FIG. 5 is a perspective view of a heat exchanger made using the tubing serpentine of FIG. 4.

Referring now to FIG. 5, the heat exchanger 35 is the result of bending the serpentine 22 of FIG. 4 as described above, positioning two or more fins 15 in spaced, parallel relation to form a fin bank 40 having lines of slots passing perpendicularly therethrough, and urging the bent serpentine through the lines of slots of the fin bank 40. The leading end of serpentine 22 is passed completely through the fin bank 40, leaving parallel runs 23 disposed in the ends of slots 16.

As can be seen in FIG. 5, the location of straight section 32 results in the middle slot of the top row being "skipped" by the serpentine. Similarly, the location and length of straight section 34, along with the fact that it is oriented vertically as seen in FIG. 5, results in the middle row of slots being skipped over.

By varying the location and length of the straight sections at the trailing edge of the serpentine, heat exchangers with a wide variety of tube layouts may be produced, all of which use fins having a common, standardized slot pattern as shown in FIG. 3.

Heat exchanger 35 may be installed in a refrigeration system to function as either a condenser or an evaporator. In either application, heat exchanger 35 is connected so that a flow of refrigerant fluid is received by serpentine 22 at inlet 24 and discharged at outlet 26. A second fluid, usually air, flows across the heat exchanger in a direction substantially parallel with fins 15 so that a thermal transfer will take place between the two fluids. In the case of a condenser, air passes over the heat exchanger to remove heat from the refrigerant flowing through serpentine 22. In an evaporator, the heat transfer occurs in the opposite direction with the refrigerant removing heat from the area to be cooled. In both cases the thermal transfer is greatly enhanced by the large surface area provided by the fins 15.

Figure 6:
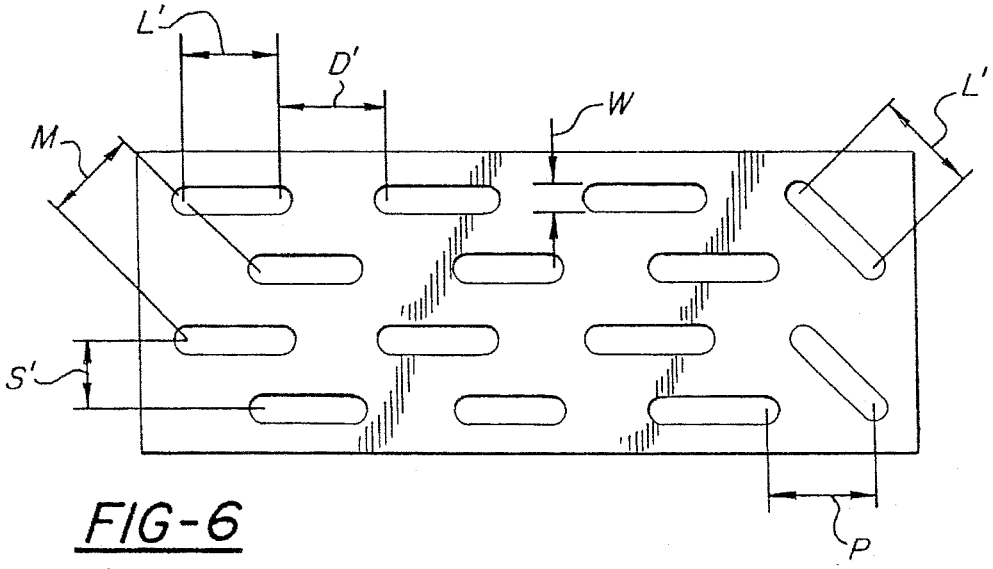
FIG. 6 is a plan view of fin plate used in a second embodiment of the present invention wherein the rows of slots are offset from one another.
Figure 7:
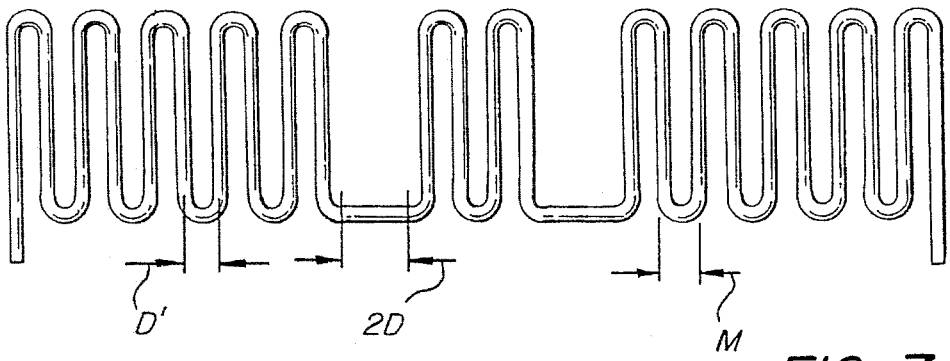
FIG. 7 is a plan view of tubing serpentine for the second embodiment of the present invention.
Figure 8:
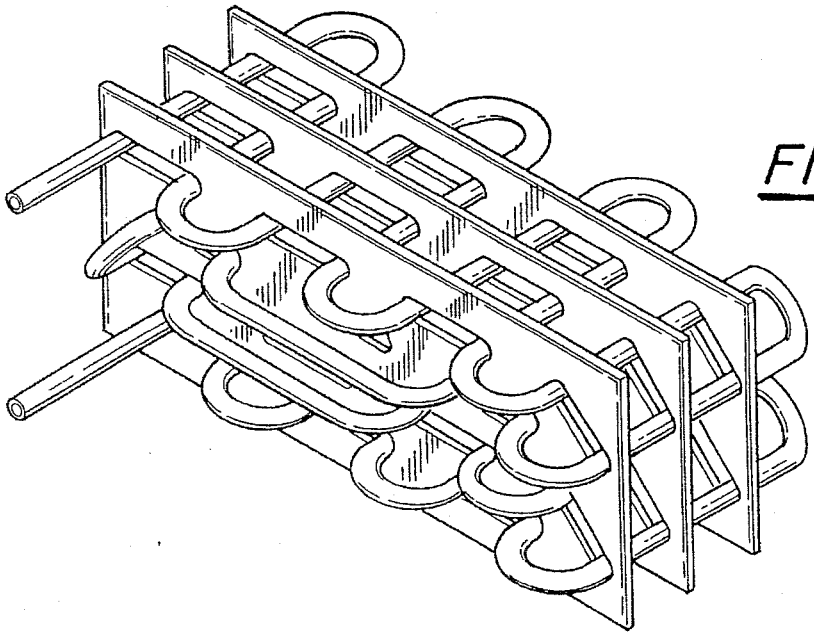
FIG. 8 is a perspective view of the second embodiment of the present invention made using the fin plate of FIG. 6 and the tubing serpentine of FIG. 7.

FIGS. 6, 7 and 8 illustrate another embodiment of the present invention in which a heat exchanger 34' is formed from fins 15' having rows of slots 16' which are offset or "staggered" with respect to each other. The stagger between rows is introduced so that an increased number of rows may be fit into a heat exchanger having a limited height H without decreasing the spacing between adjacent tube runs to an unacceptably small value. For a heat exchanger in which air flows over the tubes in a horizontal direction as seen in FIG. 8, reducing the distance between rows decreases the area available for air to pass between tube runs in adjacent rows. This may restrict air flow and so decrease the performance of the heat exchanger to an unacceptably low level, particularly if frost accumulates on the tubes and further reduces the effective air passage section. By staggering the rows, the distance M between tube runs is increased over the inter-row distance S' with a consequent increase in area available for the air passage without an increase in the overall height H of the heat exchanger.

As seen in FIG. 6, fin 15' is formed with a series of slots 16' of length L' separated by a distance D', with L'=D'. In this embodiment, however, the vertical distance between rows of slots S' is less than L'. To maintain a uniform radius for all return bends 6, diagonally oriented crossover slots 42 are provided.

As seen in FIG. 7, serpentine 44 is formed with return bends 6 of diameter D', parallel runs 23', constant radius connecting bends 28', and 90 degree bends 30' joined by straight sections 32' at the positions where there is to be a skipped slot in heat exchanger 34'. Note that since the distance P between the lower end of crossover slot 42 and the adjacent slot 16' is slightly greater than D', two very short straight segments 36 are located between two 90 degree bends 30' to form the bends at those locations. Crossover bend 38 which joins the second and third rows of slots 16' must be formed with a diameter M less than D'. Serpentine 44 is then bent out of plane to allow it to be inserted through fin pack 40' as shown in FIG. 8.

Heat exchangers having the staggered slot feature may be produced in a wide variety of tube layouts by varying the location and length of straight sections 32' at the trailing edge of serpentine 44. Production is simplified by using a common, standardized fin for all heat exchanger designs, with the configuration of the serpentine determining which slots or rows of slots will be skipped.

In view of the foregoing, it will be appreciated that the drawings, discussion, description and disclosure contained herein are merely meant to illustrate particular embodiments of the present invention and are not meant to be limitations upon the practice thereof. It is the following claims, including all equivalents, which define the scope of the invention.

We claim:

1. A method of producing a finned tube heat exchanger having a non-regular tubing layout comprising the steps of:

forming a plurality of fins each with a like pattern of equally spaced elongated slots formed therein, each slot consisting of a rectangular intermediate portion of length L and width W and two semi-circular end portions, one located at each end of and contiguous with the intermediate portion, the diameter of the end portions being at least approximately equal to width W of the intermediate portion;

positioning said fins in parallel relationship to one another with corresponding slots in alignment to form a fin bank having a plurality of lines of slots passing therethrough;

bending a single length of tubing into a serpentine having a leading end and a trailing end, the serpentine comprising:

a plurality of U-shaped tube run pairs consisting of two parallel runs of tubing joined at the leading end of the serpentine by a return bend of diameter D equal to length L of the slots, and a plurality of connecting bends which connect adjacent tube run pairs in series at the trailing end of the serpentine to establish a continuous, zigzag flow path; and telescoping the serpentine and fin bank so as to pass each of the return bends completely through a respective line of slots and to position the tube runs in the end portions of said slots;

wherein the bending step is distinguished in that at least one of the connecting bends is formed as an elongated connecting bend comprising two 90 degree bends of radius equal to D/2 connected by a straight section of tubing and wherein the telescoping step is distinguished in that at least one of the lines of slots adjacent the at least one elongated connecting bend does not receive a return bend therethrough.

2. The method of claim 1 wherein the forming step is distinguished in that:

the slots are arranged in a plurality of rows and columns, the rows aligned parallel with the elongated axis of the slots and the columns perpendicular to the rows, with all slots in a column in linear alignment with one another and the spacing between the centerlines of adjacent slots in a column equal to L.

3. The method of claim 1 wherein the fin forming step is distinguished in that:

the slots formed in each fin are arranged in a plurality of rows and columns, the rows aligned parallel with the elongated axis of the slots and the columns perpendicular to the rows, with alternating rows offset from one another in a direction parallel with the elongated axis of the slots so that adjacent slots in a column are not in linear alignment and the spacing between centerlines of adjacent slots in column is less than L.

4. The method of claim 3 wherein the forming step is further distinguished in that:

a crossover slot having the same dimensions L and W as all other slots is formed at the end of at least one row, the crossover slot being oriented at an oblique angle with respect to the length of the at least one row and spanning the distance between the at least one row and an adjacent row to position a first end portion of the crossover slot in alignment with the at least one row and a second end portion of the crossover slot in alignment with the adjacent row.

5. A finned tube heat exchanger having a non-regular tubing lay-out produced by the method having the principal steps of:

forming a plurality of fins each with a like pattern of equally spaced elongated slots formed therein, each slot consisting of a rectangular intermediate portion of length L and width W and two semi-circular end portions, one located at each end of and contiguous with the intermediate portion, the diameter of the end portions being at least approximately equal to width W of the intermediate portion;

positioning said fins in parallel relationship to one another with corresponding slots in alignment to form a fin bank having a plurality of lines of said slots passing through the fin bank;

bending a single length of tubing into a serpentine having a leading end and a trailing end, the serpentine comprising:

a plurality of U-shaped tube run pairs consisting of two parallel runs of tubing joined at the leading end of the serpentine by a return bend of diameter D equal to length L of the slots, and a plurality of connecting bends which connect adjacent tube run pairs in series at the trailing end of the serpentine to establish a continuous, zigzag flow path; and telescoping the serpentine and fin bank so as to pass each of the return bends completely through a respective line of slots and to position the tube runs in the end portions of said slots;

wherein the serpentine is distinguished in that at least one of the connecting bends is an elongated connecting bend comprising:

two 90 degree bends of radius equal to that of the return bends; and a straight section lying between and connecting the 90 degree bends and having a length equal to an integer multiple of the diameter D of the return bends; and wherein the heat exchanger is distinguished in that at least one of the lines of slots adjacent the at least one elongated connecting bend does not have a tube run pair passing therethrough.

6. The finned tube heat exchanger of claim 5 wherein the fins are distinguished in that:

the slots are arranged in a plurality of rows and columns, the rows aligned parallel with the elongated axis of the slots and the columns perpendicular to the rows, with all slots in a column in linear alignment with one another and the spacing between the centerlines of adjacent slots in a column is equal to L.

7. The finned tube heat exchanger of claim 5 wherein the fins are distinguished in that:

the slots are arranged in a plurality of rows and columns, the rows aligned parallel with the elongated axis of the slots and the columns perpendicular to the rows, with alternating rows offset from one another in a direction parallel with the elongated axis of the slots so that adjacent slots in a column are not in linear alignment and the spacing between the centerlines of the slots in a column is equal to L.

8. The finned tube heat exchanger of claim 7 wherein the fins are further distinguished in that:

a crossover slot having the same dimensions L and W as all other slots is formed at the end of at least one row, the crossover slot being oriented at an oblique angle with respect to the length of the at least one row and spanning the distance between the at least one row and a row adjacent thereto to position a first end portion of the crossover slot in alignment with the at least one row and a second end portion of the crossover slot in alignment with the adjacent row.

9. A finned tube heat exchanger comprising:

a plurality of fins each having a substantially identical pattern of spaced elongated slots formed therein, each slot comprising a rectangular intermediate portion of length L and width W and two semi-circular end portions, one located at each end of and contiguous with the intermediate portion, the diameter of the end portions being at least approximately equal to width W of the intermediate portion, the fins arranged in spaced parallel relationship to one another with corresponding slots in alignment to form a fin bank having a plurality of lines of slots passing therethrough; and a serpentine formed from a single continuous length of tubing and having a leading end and a trailing end, the serpentine comprising:

a plurality of U-shaped tube run pairs consisting of two parallel runs of tubing joined at the leading end of the serpentine by a return bend of diameter D equal to length L of the slots, a plurality of constant radius 180 degree connecting bends connecting adjacent tube run pairs in series at the trailing end of the serpentine, and at least one elongated connecting bend composed of two 90 degree bends having a radius equal to D/2 and a straight section connecting the two 90 degree bends, the straight section having a length equal to an integer multiple of D;

the tube run pairs of the serpentine passing through respective lines of slots with the tube runs lying in the end portions of the slots, and at least one of the lines of slots adjacent the at least one elongated connecting bend not receiving a tube run pair therethrough.

* * * * *